US009038285B2

(12) United States Patent
McDowell et al.

(10) Patent No.: US 9,038,285 B2
(45) Date of Patent: May 26, 2015

(54) FOOTWEAR SOLE WITH MIDSOLE PROTRUSIONS

(75) Inventors: Sean M. McDowell, Andover, MA (US); Christopher J. Edington, Portland, OR (US)

(73) Assignee: Converse Inc., North Andover, MD (US)

( * ) Notice: Subject to any disclaimer, the term of this patent is extended or adjusted under 35 U.S.C. 154(b) by 596 days.

(21) Appl. No.: 13/313,781

(22) Filed: Dec. 7, 2011

(65) Prior Publication Data

US 2012/0144695 A1 Jun. 14, 2012

Related U.S. Application Data

(60) Provisional application No. 61/421,993, filed on Dec. 10, 2010.

(51) Int. Cl.

| | |
|---|---|
| ***A43B 13/20*** | (2006.01) |
| ***A43B 13/12*** | (2006.01) |
| ***A43B 13/14*** | (2006.01) |
| ***A43B 13/22*** | (2006.01) |
| ***A43B 13/36*** | (2006.01) |

(52) U.S. Cl.

CPC ..... *A43B 13/122* (2013.01); *A43B 13/20* (2013.01); *A43B 13/14* (2013.01); *A43B 13/223* (2013.01); *A43B 13/36* (2013.01)

(58) Field of Classification Search

CPC ..... A43B 13/223; A43B 13/14; A43B 13/20; A43B 13/122

USPC ..... 36/30 R, 28, 29, 25 R

See application file for complete search history.

(56) References Cited

U.S. PATENT DOCUMENTS

| | | | | |
|---|---|---|---|---|
| 1,607,375 | A * | 11/1926 | Whipple | 428/163 |
| 3,834,046 | A * | 9/1974 | Fowler | 36/28 |
| 5,174,049 | A | 12/1992 | Flemming | |
| 5,619,809 | A * | 4/1997 | Sessa | 36/3 R |
| 7,140,129 | B2 * | 11/2006 | Newson et al. | 36/100 |
| 2008/0229617 | A1 | 9/2008 | Johnson et al. | |

FOREIGN PATENT DOCUMENTS

| | | | | |
|---|---|---|---|---|
| EP | 666039 | A2 * | 8/1995 | A43B 13/18 |

OTHER PUBLICATIONS

Notification of Transmittal of the International Search Report and the Written Opinion of the international Searching Authority, or the Declaration in PCT/US2011/064221 dated Apr. 2, 2012, 11 pages.

* cited by examiner

*Primary Examiner* — Ted Kavanaugh

(74) *Attorney, Agent, or Firm* — Shook, Hardy Bacon

(57) ABSTRACT

Embodiments of the present invention relate to a footwear sole including a midsole and an outsole. The midsole includes of a plurality of protrusions extending downwardly from a bottom surface of the midsole toward the outsole. The outsole may include a plurality of recesses positioned to mate with a corresponding protrusion from the midsole. The outsole may also include one or more protrusion extending downwardly from the bottom of the outsole. The outsole protrusions may correspond with an associated recess of the outsole top surface. The protrusions may be hemispherical in shape at their distal ends so that a portion of the distal end may be received by the corresponding recess of the outsole top surface.

18 Claims, 3 Drawing Sheets

FOOTWEAR SOLE WITH MIDSOLE PROTRUSIONS

CROSS-REFERENCE TO RELATED APPLICATIONS

This application claims benefit to U.S. Provisional Application No. 61/421,993, filed on Dec. 10, 2010, entitled "Footwear Sole With Midsole Protrusions," which is incorporated in its entirety by reference herein.

BACKGROUND

A shoe sole is typically constructed having a midsole, an outsole, and possibly an insert. The shoe sole serves as a platform to support a foot of a wearer. As such, the ability of the shoe sole to absorb compression energy, gain/maintain traction, and resist an abrasive surface are all characteristics that may be desired in a shoe sole. Consequently, various aspects of a shoe sole may be adjusted or otherwise manipulated to improve one or more of the desired characteristics of the shoe sole.

SUMMARY

Embodiments of the present invention relate to a footwear sole comprising a midsole and an outsole. The midsole is comprised of a plurality of protrusions extending downwardly from a bottom surface of the midsole toward the outsole. The outsole may include a plurality of recesses positioned to mate with a corresponding protrusion from the midsole. The outsole may also include one or more protrusions extending downwardly from the bottom of the outsole. The outsole protrusions may correspond with an associated recess of the outsole top surface. The protrusions may be hemispherical in shape at their distal ends so that a portion of the distal end may be received by the corresponding recess of the outsole top surface.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
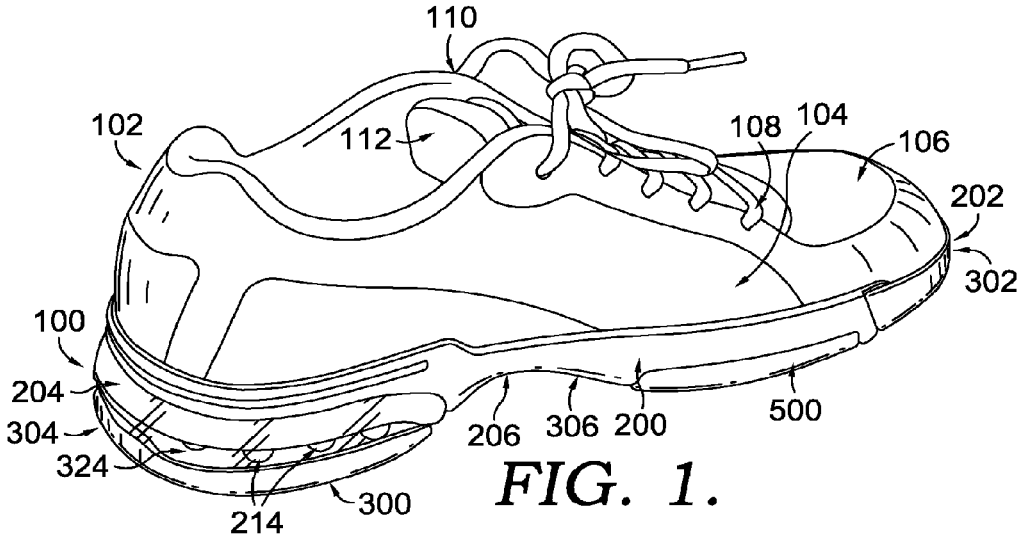
FIG. 1 depicts a medial perspective view of an exemplary shoe, in accordance with embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to a footwear sole comprising a midsole and an outsole. The midsole is comprised of a plurality of protrusions extending downwardly from a bottom surface of the midsole toward the outsole. The outsole includes a plurality of recesses positioned to mate with a corresponding protrusion from the midsole. The outsole may also include one or more protrusions extending downwardly from the bottom of the outsole such that the outsole protrusions may correspond with an associated recess of the outsole top surface. The protrusions may be hemispherical in shape at their distal ends so that a portion of the distal end may be received by the corresponding recess of the outsole top surface.

Accordingly, in one aspect, the present invention provides a footwear sole having a midsole and an outsole. The midsole is comprised of a plurality of protrusions extending downwardly from a midsole top surface. At least some of the protrusions terminate with a distal end having a convex contour. The outsole includes an outsole top surface that has a plurality of recesses extending downwardly toward an outsole bottom surface. At least some of the recesses have a concave contour corresponding to an associated protrusion of the midsole. In this exemplary embodiment, the midsole and the outsole are affixed together so that a distal end of a protrusion mates to an associated recess of the outsole.

A second aspect of the present invention provides an additional embodiment of a footwear sole. The footwear sole, in this exemplary embodiment, includes a midsole and an outsole. The midsole has a midsole perimeter, a midsole top surface, and a baseline bottom surface. Additionally, the midsole includes a plurality of protrusions that extend downwardly from the baseline bottom surface of the midsole. Consequently, the plurality of protrusions form a protrusion bottom surface of the midsole. In this exemplary embodiment, the plurality of protrusions and the midsole are formed of a cohesive material. The outsole has an outsole top surface and an outsole bottom surface. The outsole and the midsole are affixed near the midsole perimeter and near a portion of the protrusion bottom surface. The outsole and the midsole are not affixed near the baseline bottom surface remote from the perimeter.

A third aspect of the present invention provides an additional embodiment of a footwear sole having a perimeter defined by a toe end, a heal end, a medial side, and a lateral side. The footwear sole includes a midsole having a midsole top surface and an opposite midsole bottom surface. The midsole bottom surface is formed from a baseline bottom surface and a plurality of protrusions extending downwardly from the baseline bottom surface. Each of the plurality of protrusions has a hemispherical-shaped distal end. The outsole has an outsole top surface and an outsole bottom surface. The outsole top surface includes a plurality of recesses. Each of the recesses corresponds to an associated protrusion. A first recess is shaped to substantially receive a portion of a hemisphere-shaped distal end of a protrusion. The outsole bottom surface includes a plurality of outsole protrusions. The plurality of outsole protrusions correspond to the plurality of recesses of the outsole top surface. The footwear sole also includes a bonding agent. The bonding agent couples the midsole to the outsole near the perimeter and also near the hemisphere-shaped distal end of the first protrusion. The midsole and the outsole are not coupled near the baseline bottom surface that is remote from the perimeter.

Having briefly described an overview of embodiments of the present invention, a more detailed description follows.

The construction of an exemplary article of footwear ("shoe") 102 of the present invention has the basic construction of a traditional shoe. However, the shoe 102 is comprised of a sole 100 constructed from a midsole 200 having a plurality of protrusions 214 extending downwardly from the midsole 200 towards an outsole 300. The midsole 200 and the outsole 300 are coupled proximate a distal end 228 of each of the protrusions of the plurality of protrusions 214. Additionally, it is contemplated that the midsole 200 and the outsole 300 may be coupled (e.g., bonded) together along a perimeter of the sole 100 to form a substantially air-tight cavity disposed between the midsole 200 and the outsole 300. As will be discussed in more detail, the outsole 300 may have a plurality of recesses 316 in a top surface that are shaped to mate with the distal ends of the plurality of protrusions 214. Further yet, it is also contemplated and will be discussed in more detail below that an outsole bottom surface may also contain a plurality of protrusions extending downwardly in conjunction with one or more of the recesses of the outsole top surface.

In embodiments, the shoe 102 is a high-top basketball-style shoe. However, it should be understood that the sole 100 could be employed on other types of shoes (e.g., low-top, infant, toddler, children, adult, cross-training, running, lifting, sandals, clogs, boots, and the like). Because much of the construction of the shoe 102 is the same as that of a conventional shoe, the conventional features of the constructions will be described only generally herein.

The shoe 102 also is constructed with an upper 104. The upper 104 is secured to the sole 100 and extends upwardly from a midsole top surface 210. The upper 104 is constructed of a flexible material, for example leather, polymer, or a fabric such as canvas.

The upper 104 has a medial side portion and a lateral side portion that extend along a respective midsole medial side 206 and a midsole lateral side 208. The upper medial side portion extends upwardly from the midsole medial side 206 to an upper medial side edge. The upper lateral side portion extends upwardly from the midsole lateral side 208 to an upper lateral side edge. As partially illustrated in FIG. 1, the upper medial side edge and the upper lateral side edge extend rearwardly from opposite sides of a front toe end 202 of the sole 100. As is typical, a length of the upper medial side edge and the upper lateral side edge define a forefoot opening in the upper 104 that opens to a shoe interior.

As is typical of a shoe construction, the upper 104 may also be constructed with a toe box 106 that extends around and across a midsole top surface 210 at the sole toe end 202. The toe box 106, in this exemplary embodiment, is connected between the upper medial side portion and the upper lateral side portion and encloses a portion of the shoe interior adjacent the midsole toe end 202. The upper medial side edge and the upper lateral side edge may extend rearwardly from the toe box 106.

A first plurality of apertures 108 are provided on the upper medial side portion and a second plurality of apertures 110 are provided on the upper lateral side portion. The apertures 108 and 110 are lacing openings in an exemplary embodiment. A lacing opening is an opening that is typically occupied by a portion of a fastener, such as lacing that closes the shoe upper over the forefoot opening of the shoe. The apertures 108 and 110 may provide any type of lacing openings on the shoe, for example, D-rings or speed lacing hooks. However, in an exemplary embodiment, the apertures 108 and 110 are an eyelet or grommet style aperture. The apertures 108 and 110 are arranged in lines along the upper medial side portion and the upper lateral side portion, as is conventional. As partially illustrated in the figures, the apertures 108 and 110, in an exemplary embodiment, extend substantially the entire length of the upper medial side edge and the upper lateral side edge.

The shoe upper 104 may include a vamp or a throat positioned rearwardly of the toe box 106, and a tongue 112 that extends rearwardly from the vamp through the forefoot opening. The tongue 112 extends along the lengths of the upper medial side portion and the upper lateral side portion to a distal end of the tongue, a tongue upper edge, near an ankle opening.

It is understood that the sole 100 may be utilized with a variety of footwear configurations; therefore, while a particular embodiment is discussed with respect to FIG. 1, it is contemplated that the upper 104 (or any of the features discussed in association with the upper 104) may not be implemented with the sole 100. For example, the sole 100 may be utilized in conjunction with a sandal having a strap or other configuration to secure the sole 100 to the foot of a wearer as opposed to the upper 104 discussed previously.

Figure 7:
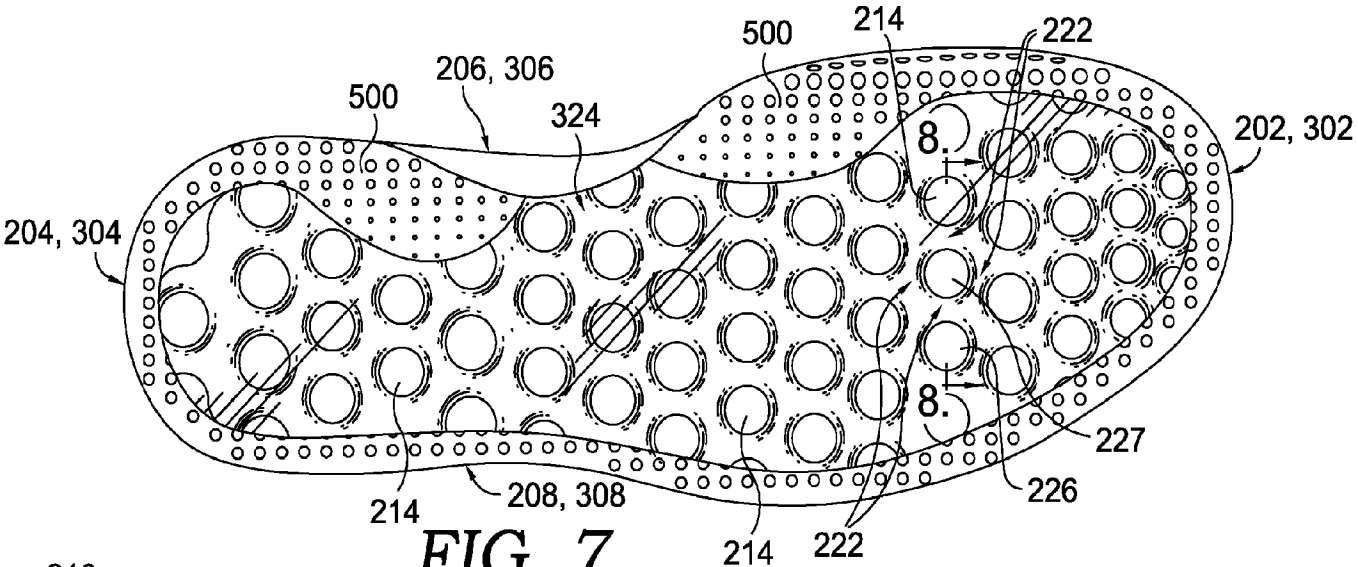
FIG. 7 depicts a bottom surface view of a sole constructed with a midsole having protrusions, in accordance with an embodiment of the present invention.

As is typical with a shoe, the size of the shoe 102 has a length that extends from an outsole heel end 304 to an outsole toe end 302 of the sole 100. As best seen in FIG. 7, the shoe 102 has a width that extends between an outsole medial side 306 and an outsole lateral side 308 of the sole 100.

Figure 2:
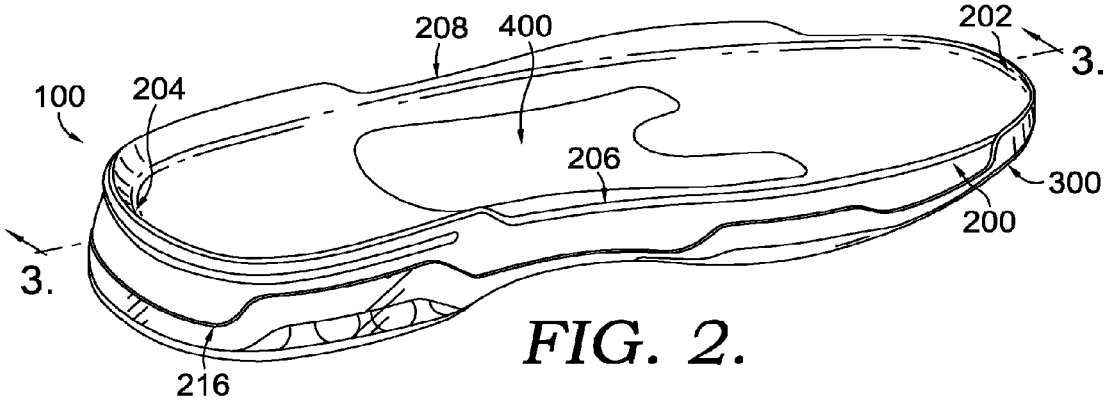
FIG. 2 depicts a medial perspective view of a sole having a midsole with protrusions, in accordance with an embodiment of the present invention.

Additional features of the shoe 102 include an inset 400. However, because of the novel construction of the sole 100, the insert 400 (as best seen in FIG. 2) may be shaped and/or positioned to provide additional functionality to the shoe 102. For example, as will be discussed below, the midsole 200 is comprised of the plurality of protrusions 214 that extend to the outsole 300. Because force may be transferred upwardly from the outsole 300 through the plurality of protrusions 214 to a wearer's foot, a perception of a concentrated force may be experienced by a wearer at locations of the foot corresponding to each of the plurality of protrusions 214. In particular, an arch of a foot may experience more sensitivity to concentrated regions of force caused by the transfer of force through protrusions in that area of the arch. The insert 400 may be used to dissipate or spread the force across a greater surface area. Consequently, it is contemplated that the insert 400 is constructed from semi-rigid to rigid material. For example, a plastic, metal, dense foam, or other suitable material may be implemented.

In addition to material selection of the insert 400, the shape and positioning of the insert 400 may be altered to achieve the desired results. The shape of the insert 400 may be formed to cover the midsole top surface 210 at locations corresponding to one or more protrusions extending from the midsole bottom surface 212. Similarly, the location of the insert 400 may be adjusted about the midsole top surface 210 to particularly "cover" one or more protrusions extending from the midsole bottom surface 212 to dampening the focused force that may be experienced from the wearer's foot. For example, the insert 400 depicted in FIG. 2 is an exemplary insert 400 that is shaped to transfer forces that would normally be experienced by a wearer's foot in an arch area to a lateral, a toe end, and a heel end, of the wearer's foot. This may provide additional support and stability to the shoe 102. As insinuated throughout, the utilization of the insert 400 provides additional benefits not traditionally realized in a shoe having a standard sole that is formed without the plurality of protrusions and other features discussed herein with respect to the sole 100.

Other features of the shoe 102 that are not specifically depicted include a lasting board of an upper that may be coupled to the sole 100. Similar in functionality discussed with respect to the insert 400, the lasting board may provide a dampening of focused forces caused by individual protrusions extending from the midsole 200. Also, it is contemplated that the midsole top surface 210 may have one or more additional layers of material incorporated or added to provide a similar function. Further, it is contemplated that the top portion of the midsole 200 that extends from the baseline bottom surface 218 to the midsole top surface 210 may serve to distribute forces that may otherwise be concentrated by the plurality of protrusions 214. For example, the top portion may be formed to have a greater density of foam material than is used to form one or more of the plurality of protrusions 214. Also it is contemplated that a thickness of the top portion is adjusted to achieve one or more of the functions discussed herein.

The shoe 102 has a shoe outsole 300 that is constructed of resilient materials that are typically employed in the construction of outsoles of athletic shoes or other footwear. For example, a synthetic or natural rubber and/or polymers may be used to form the outsole 300 in an exemplary embodiment. The outsole 300 may include treads or other traction-gaining formations on an outsole bottom surface 312. The outsole bottom surface 312 traditionally contacts the ground or other surfaces for which the shoe 102 is intended to be used. For example, the term "ground" may include a court, a pitch, a field, a track, a mat, a floor, and the like. Therefore, to provide a relational understanding of the orientation of one or more surfaces discussed herein, a general term of the ground may imply any contacting surface for which the bottom of the outsole is intended to contact. Relational terms are used herein, such as bottom, down, top, and up, which generally refer to a direction when the shoe 102 is worn in a traditional fashion. Therefore, the term "downwardly," for example, generally refers to a direction towards a direction of the "ground," as discussed above.

Figure 5:
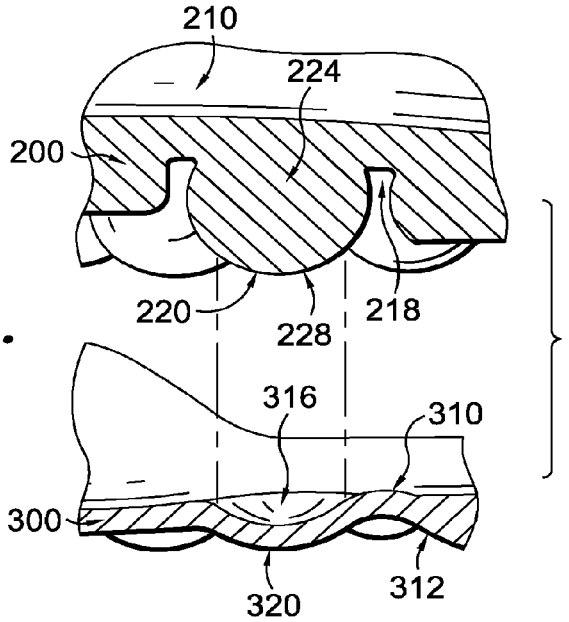
FIG. 5 depicts a zoomed exploded medial cross sectional view of the encircled region of FIG. 4 of a midsole with protrusions and an outsole having corresponding recesses, in accordance with an embodiment of the present invention.

As mentioned above, the outsole 300 has a perimeter defined by the outsole toe end 302, the outsole heel end 304, the outsole medial side 306, and the outsole lateral side 308, as best seen in FIG. 7. Additionally, the outsole 300 includes an outsole top surface 310, as best seen in FIG. 5. Further, the outsole 300 also includes the outsole bottom surface 312, which previously was discussed as providing, at least in part, a ground contacting surface for the shoe 102.

The sole 100 is also comprised of the midsole 200. The midsole 200 has a perimeter 216 defined by a toe end 202, a heel end 204, a medial side 206, and a lateral side 208, as also best seen in FIG. 7. The midsole 200 also includes the midsole top surface 210 and the opposite midsole bottom surface 212. The midsole top surface 210 is a portion of the sole 100 to which a foot may contact. However, it is understood that one or more additional layers, such as liners, inserts, booties, socks, and the like may be positioned between the midsole top surface 210 and a bottom of a wearer's foot. But, to provide a relational description of the sole 100, the midsole top surface 210 may provide a surface on to which a wearer's foot is supported, in an exemplary embodiment.

FIG. 2 depicts the sole 100 constructed with the midsole 200 and the outsole 300 in accordance with embodiments of the present invention. As depicted in FIG. 2, the perimeter 216 extends around the sole 100, and in an exemplary embodiment, defines where the outsole 300 may be coupled to the midsole 200. It is contemplated that the perimeter of the outsole 300 and the perimeter 216 of the midsole 200 allow for the midsole 200 and the outsole 300 to be mated forming a substantially air-tight junction (e.g., bond, seal) that may be utilized to maintain a quantity of air between the midsole 200 and the outsole 300. The phrase "substantially air-tight" is used herein to account for imperfections in material, manufacturing, and other typical variable that may allow the unintentional or larger than anticipated volumes of gas/air to escape from an enclosed volume.

In an exemplary embodiment, it is contemplated that one or more portions of the sole 100 are absent to allow access to one or more of the plurality of protrusions 214. For example, it is contemplated that the portion of the sole 100 that is depicted as the transparent portion 324 of FIG. 1 is a representation of an absent portion of the sole 100, in an exemplary embodiment. In an additional example, it is contemplated that a portion of a substantially vertical section (portion extending between the outsole top surface 310 and the outsole bottom surface 312) is a void that forms an opening into a volume of space surrounding the plurality of protrusions 214 as they extend downwardly from the midsole bottom surface 212 toward the outsole top surface 310. Functionally, an absence of a portion of the sole 100, such as a vertical section, may allow for water and other debris to pass through the sole 100. Additional functionality provided by an absence in the sole 100 may include visibility of one or more bonds between the midsole 200 and the outsole 300 to ensure proper cohesion between the midsole 200 and the outsole 300. It is understood that additional functionality is contemplated with the inclusion of an opening or absence in the sole 100.

Figure 3:
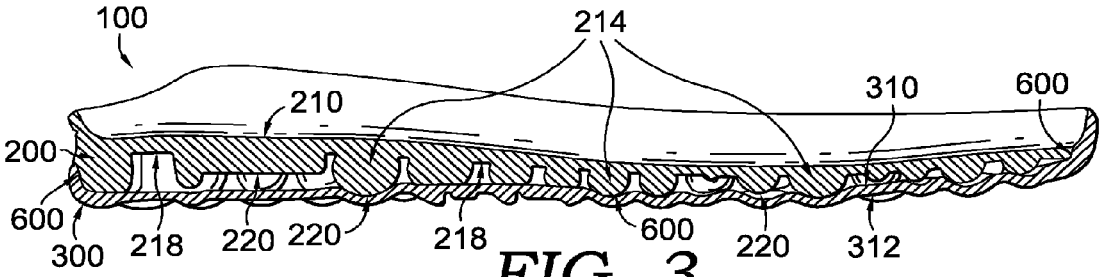
FIG. 3 depicts a medial cross sectional view of a midsole taken along line 3-3 of FIG. 2 with protrusions and an outsole having corresponding recesses, in accordance with an embodiment of the present invention.

FIG. 3 depicts a cross section of the sole 100, in accordance with embodiments of the present invention. FIG. 3 illustrates the plurality of protrusions 214 extending downwardly from the midsole 200 toward the outsole 300. Additionally, in this exemplary embodiment, the plurality of protrusions 214 are depicted as being formed from a unitary (common) material as the midsole 200. For example, it is contemplated that a foam material is used to form the midsole 200, including the plurality of protrusions 214. In particular, it is contemplated a molding process is implemented to form the midsole 200, including the plurality of protrusions 214, in a common operation. In this example, the plurality of protrusions 214 are formed with the midsole 200 and not later added or otherwise coupled to the midsole 200. This may allow for uniformity in material, reduced manufacturing costs/time, and better quality control by cohesively forming the plurality of protrusions 214 with the midsole 200. However, it is contemplated that one or more of the plurality of protrusions may be formed separately from, and then coupled to, the midsole 200 in an exemplary embodiment of the present invention.

Additionally, as illustrated in FIG. 3 (and as seen from the bottom perspective of FIG. 7), it is contemplated that one or more of the plurality of protrusions 214 may have different sizes. For example, the size of a protrusion may be varied depending on the location of the protrusion. As depicted in FIG. 3, a protrusion closer to the toe end may have a smaller vertical cross section (a vertical cross section is depicted in FIG. 3) than a protrusion closer to the heel end. As used herein, a smaller cross section may include a volume of material (or an area exposed in a cross-section view) used to form the particular protrusion. For example, it is contemplated that a protrusion is formed having a cylindrical body extending downwardly from the midsole 200, but having a concave or convex distal end (as will be discussed with FIGS. 5-8 hereinafter). Therefore, a protrusion having a smaller cross section may have a smaller cylindrically body (diameter and/or length) and/or a smaller distal end. Similarly, a protrusion in one area may have a greater downward extension (e.g., height) then another protrusion located at a different location.

Similarly, it is contemplated that spacing or separation along the midsole bottom surface 212 between the plurality of protrusions (as best seen in FIG. 7) may also be varied according to a relative position on the sole 100. For example, it is contemplated that the smaller a protrusion, the closer that protrusion may be to a neighboring protrusion. Conversely, the larger a protrusion, the farther (or more separated) that protrusion may be from a neighboring protrusion. Additionally, it is contemplated that spacing between protrusions may not be a function of the protrusion size, but instead based on the anatomy of a foot to be supported by the sole 100. For example, in a location of higher load (e.g., ball of the foot, heel of the foot) the spacing may be reduced and the size may be increased of the various protrusions to compensate for the greater load within that region.

In an exemplary embodiment, regions of the midsole 200 are formed from different material or differing characteristics of a common material. For example, it is contemplated that a common foam material is used to construct the majority of the midsole 200; however, the common/unitary foam material may have a varied density based on region. In an example, the regions of varied materials or characteristics of the material may include, but not be limited to, a lateral side region, a heal region, an arch region, a ball of the foot region, a medial side region, and a toe region. For example, it is contemplated that foam having a greater density may be utilized in the lateral side region to provide additional support to a lateral portion of a wearer's foot when in an as-worn position. Similarly, it is contemplated that foam having a reduced density (softer) is utilized in the midsole 200 proximate the heel region to provide a softer feel to the wearer when in an as-worn position.

In addition to altering specific characteristics (e.g., density) of a unitary material, it is contemplated that the midsole is formed from a plurality of materials to achieve different advantages in specific regions. The formation of the midsole having different material may result in a unitary midsole in that it is formed from a common manufacturing operation. An example of a unitary midsole having different materials includes utilizing a different foam material that provides more support in the lateral side region of the midsole 200 to provide the additional support. In this example, a different foam may also be utilized in the arch region that provides sufficient support to the arch of the wearer, but has a lighter weight than the other material used in the midsole 200 to reduce the weight of the sole 100. Therefore, it is contemplated that a material or characteristic of the material used to form at least a portion of the midsole 200 may be varied based on location to achieve different performance of the sole 100.

Figure 4:
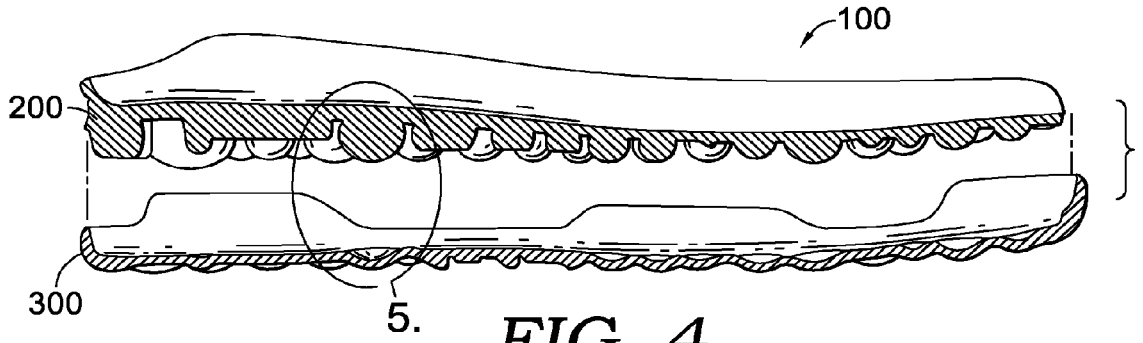
FIG. 4 depicts an exploded medial cross sectional view of a midsole with protrusions and an outsole having corresponding recesses, in accordance with an embodiment of the present invention.

FIG. 4 illustrates the midsole 200 separated from the outsole 300 for purposes of explanation and clarity. FIG. 5 illustrates a closer view of a portion depicted in FIG. 4. In particular, FIG. 5 depicts the midsole 200 separated (for purposes of discussion) from the outsole 300. The midsole bottom surface 212 is depicted as having a baseline bottom surface 218 and a protrusion bottom surface 220. The baseline bottom surface 218 represents the portion of the bottom surface 212 that separates the plurality of protrusions 214. In particular, a protrusion 224 is depicted as downwardly extending from the baseline bottom surface 218 such that a distal end 228 forms a portion of the protrusion bottom surface 220 proximate the protrusion 224. Therefore, in an exemplary embodiment, the baseline bottom surface 218 in combination with the protrusion bottom surface 220 form the midsole bottom surface 212. It is contemplated that each of the plurality of protrusions 214, in combination, form the protrusion bottom surface 220 as they extend downwardly from the baseline bottom surface 218.

In an exemplary embodiment, the baseline bottom surface 218 is not discontinuous (e.g., is continuous) across the midsole bottom surface 212. For example, it is contemplated that a protrusion does not extend the entire width, the entire length, or other entire bisecting directions to prevent a unitary baseline bottom surface 218 across the midsole bottom surface 212. In an exemplary embodiment, having a continuous (but yet still allowing spaced protrusions) baseline bottom surface 218 allows air to pass from one side of a protrusion to another side of the protrusion when the midsole 200 is coupled to the outsole 300 by the perimeter 216 and the distal end 228. Stated differently, a continuous baseline bottom surface 218 allows for a substantially similar air pressure to be uniformly experienced (and resulting support) by a wearer of the sole 100. However, it is also contemplated that a discontinuous baseline bottom surface 218 may be utilized to isolate portions for selective air pressures and associated characteristics.

In an exemplary embodiment, the midsole 200 is coupled to the outsole near the perimeter 216 and near one or more of the plurality of protrusions 214 (where the protrusions contact the outsole 300). However, it is contemplated that the outsole 300 is not coupled with/to the midsole 200 at any point of the baseline bottom surface 218, except where a portion of the baseline bottom surface 218 may be also characterized as part of the perimeter 216. For example, because the baseline bottom surface 218 may form a part of or turn into the perimeter 216, there may technically be a bonding of the midsole 200 to the outsole 300 at the baseline bottom surface 218 in one or more of these scenarios; however, it is contemplated that the outsole 300 and the midsole 200 are not coupled at a location remote from a perimeter of the sole 100 (e.g., substantially away from the perimeter).

The distal end 228 of the protrusion 224 (as depicted in FIG. 5) has a convex contour. Stated differently, the distal end 228 has a partial spherical shape. The convex shape of the distal end 228 provides several functional characteristics. For example, the convex shape may allow for easier alignment with a corresponding recess (e.g., a recess 316) in the outsole 300 during manufacturing. Additionally, a convex shape may provide a variable resistance to force. For example, the more compression that occurs to a spherical shape, the more of the spherical shape that is compressed. Consequently, a convex shape may provide a non-linear resistance to force (e.g., compression force exerted by a wearer's foot) that increases with the amount of force applied. Further yet, as will be discussed hereinafter, a convex shape of the distal end 228 may result in an outsole protrusion 320 having a corresponding shape extending downwardly from the outsole 300. For example, functionally, it may be advantageous to have a rounded (i.e., hemispherical) protrusion extending from the outsole 300 to provide traction, wearability, and impact attenuating response to the sole 100.

Figure 6:
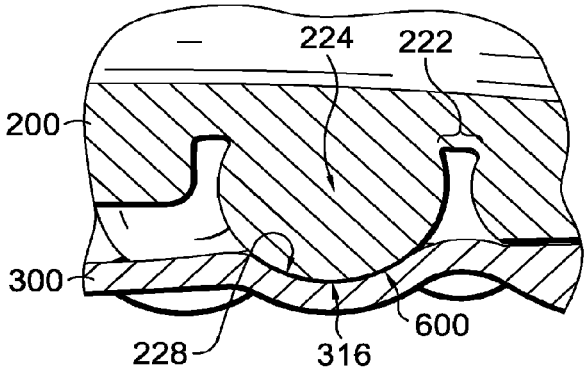
FIG. 6 is a view similar to FIG. 5, but with the midsole and outsole abutted together.

FIG. 5 also shows the outsole 300 having the outsole top surface 310, the outsole bottom surface 312, the recess 316, and the corresponding outsole protrusion 320. As shown in FIG. 6, the distal end 228 of the protrusion 224 may be positioned in the recess 316 of the outsole 300. It is contemplated that the contour of the recess 316 is formed to correspond with the distal end 228 portion to be received (and possibly coupled with). Therefore, in an exemplary embodiment, the recess 316, which is one of a plurality of recesses 314 of the outsole 300, has a concave form that corresponds to the convex shape of the distal end 228. However, it is contemplated that the outsole top surface 310 is non-conforming (flat or otherwise contoured) to one or more protrusions extending from the midsole 200.

FIG. 6 also illustrates a discontinuous protrusion region 222. The discontinuous protrusion region 222 refers to the lack of a continuous nature of a protrusion (e.g., the protrusion 224). Therefore, having a discontinuous protrusion region surrounding one or more protrusions allows for a continuous baseline bottom surface 218. This is further illustrated in FIG. 7, where the discontinuous protrusion region 222 surrounds a protrusion 227. As a result, the protrusion 227 is not continuous from one portion of the perimeter 216 to an opposite portion of the perimeter 216.

Figure 8:
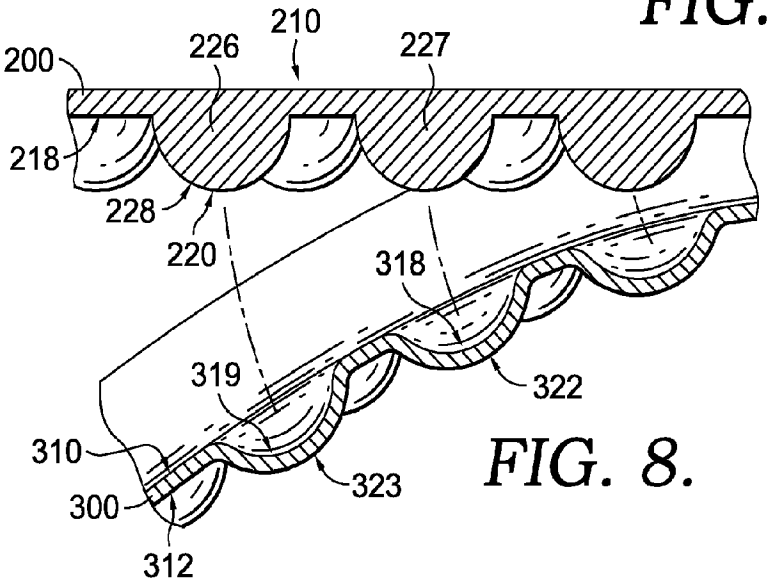
FIG. 8 depicts a cross section view of a plurality of protrusions taken along line 8-8 of FIG. 7 and peeled from corresponding recesses, in accordance with an embodiment of the present invention.

FIG. 8 illustrates a vertical cross sectional peeling view of a first protrusion 226 and the second protrusion 227 (as identified in FIG. 7), in accordance with embodiments of the present invention. The outsole 300 is peeled back from the midsole 200 to show a possible mating relationship among a plurality of protrusions. The first protrusion 226 has a distal end 228 that is received at (and possibly coupled to) a first recess 319. In this example, the first recess 319 translates into a first outsole protrusion 323. Similarly, the second protrusion 227 is received at (and possibly coupled to) a second recess 318. Also in this exemplary embodiment, the second recess 318 corresponds to a second outsole protrusion 322. In both instances, the first recess 319 and the second recess 318 are a concave contour shaped and positioned to receive at least a portion of a corresponding protrusion, the first protrusion 226 and the second protrusion 227 respectively.

The outsole bottom surface 312 may include one or more functional contours, such as the protrusions 323 and 322. As previously discussed, it is contemplated that one or more recesses of the outsole top surface 310 may correspond to one or more protrusions extending downwardly from the outsole bottom surface 312. For example, the outsole 300 may be formed from a material have a substantially uniform thickness; consequently, if a recess is placed on a top surface, to maintain the substantially uniform thickness, a protrusion may result on the bottom surface. Additionally, irrespective of maintaining a consistent thickness, a recess corresponding to a protrusion of the outsole may facilitate that transferring of compressive force in a more direct path through the sole 100. Further yet, it is contemplated that a protrusion of the outsole 300 provides a traction-gaining surface that may enhance the usability of the associated shoe.

In an exemplary embodiment, it is contemplated that the protrusions of the outsole bottom surface 312 allows each of the corresponding plurality of protrusions 214 to act more independently of one another than is provided by a typical mono-sole of cushioning foam used in a typical shoe's sole. For example, a protrusion from the outsole outer surface 312 allows for a direct transfer of energy (load) to the wearer of the shoe through a corresponding protrusion of the midsole 200. Consequently, a greater degree of cushioning control may be achieved by manipulating individual protrusions of the midsole 200 than could be achieved through a mono-sole foam that is a continuous/interconnected surface and volume. Therefore, the direct and focused transfer of energy from the ground to individual protrusions of the midsole 200 provides an independent cushioning mechanisms not achieved by a typical shoe having a mono-foam sole.

In an exemplary embodiment, the outsole 300 is formed, at least in part, to include one or more semi-transparent portions, such as the portion 324 depicted in FIG. 7 (interior portion of the sole bottom surface) or the portion 324 depicted in FIG. 1 (heel portion of the sole 100). A semi-transparent portion allows an amount of compression of one or more of the plurality of protrusions 214 to be monitored. Additionally, a semi-transparent portion may allow a characteristic of the sole 100 to be verified (e.g., protrusion density, ability to maintain a volume of air). As used herein a semi-transparent portion may allow a view (which may be partially obscured, blocked, or otherwise degraded) of a portion internal to the sole 100. It is contemplated that the semi-transparent portion may, however, provide a substantially air-tight barrier to prevent a volume of air between the outsole 300 and the midsole 200 from changing.

In yet another exemplary embodiment, an outsole supplement 500 (as best seen in FIG. 7) may be used in conjunction with the sole 100. The outsole supplement may be a resilient material having different properties than the material used to form the outsole 300. For example, areas of the sole 100 subject to greater abrasion experience or areas optimized for greater grip may be enhanced with one or more outsole supplements 500. For example, a durable rubber may be used proximate a bottom surface perimeter of the outsole to provide better durability than may be provided by the material utilized to form the outsole 300. The outsole supplement 500 may be coupled (e.g., adhered, bonded, welded, fastened, and the like) to the outsole bottom surface 312.

Terms such as bonded, coupled, affixed, adhered, and the like ("coupled) are used herein to describe the temporary, semi-permanent, and/or permanent joining of two components, elements, features, etc. It is contemplated that a first portion may be coupled to a second portion using a number of techniques. For example, glues, adhesives, chemical welding, ultrasonic welding, stitching, tacking, mechanical fasteners, and the like, may be implemented in any combination.

It is contemplated that a bonding agent 600 is used to couple a first portion to a second portion. For example, it is contemplated that the outsole 300 is coupled to the midsole 200 along the perimeter 216. The coupling may be accomplished with the bonding agent 600 such that a volume of air between the midsole bottom surface 212 and the outsole top surface 310 is contained within the space defined by these two surfaces. Additionally, it is contemplated that the bonding agent 600 may also be applied to one or more protrusions to couple the protrusion to the outsole 300. For example, the bonding agent 600 may be utilized so that a portion of a distal end of a protrusion is coupled to a corresponding recess of the outsole 300. Further, it is contemplated that the bonding agent 600 may be used in some, but not all, points of contact between the midsole 200 and the outsole 300. Further, it is contemplated that the bonding agent 600 is not even a material, but instead a result of the coupling of two portions (e.g., material formed from chemical welding, material formed from ultrasonic welding, material formed from RF welding).

Consequently, one or more exemplary embodiments may implement features discussed herein. For example, the sole 100 may include the plurality of protrusions 214 extending from the midsole 200 toward the outsole 300. The plurality of protrusions 214 may be dispersed across one or more regions of the sole 100 (e.g., near the heel end, near the toe end, near the medial side, near the lateral side, near an arch support region, and any combination therefore). The plurality of protrusions 214 may be formed of the same material as the midsole 200. The plurality of protrusions 214 may be formed as part of the midsole 200 during the formation of the midsole 200. Additionally, the plurality of protrusions 214 may be formed as a unitary portion (e.g., common material, common process, formed as one common element) of the midsole 200. A protrusion may be cylindrical in shape (e.g., having a circular horizontal cross section and a non-circular vertical cross section), they may be hemispherical in shape, they may be spherical in shape, they may be rectangular in shape, they may be oblong in shape, they may be spiral in shape, and/or the like. Further, it is contemplated that the plurality of protrusions may extend upwardly from the outsole 300 to be mated with the midsole 200.

Although the footwear sole is described above by referring to particular embodiments, it should be understood that the modifications and variations could be made to the shoe construction described without departing from the intended scope of protection provided by the following claims.

The invention claimed is:

1. A footwear sole having a perimeter defined by a toe end, a heal end, a medial side, and a lateral side, comprising:

a midsole having a midsole top surface and an opposite midsole bottom surface, wherein the midsole bottom surface is comprised of a baseline bottom surface and a plurality of protrusions extending downwardly from the baseline bottom surface, each of the plurality of protrusions have a hemisphere-shaped distal end;

an outsole having an outsole top surface and an outsole bottom surface, the outsole top surface is comprised of a plurality of recesses such that each of the plurality of recesses corresponds to an associated protrusion of the plurality of protrusions, wherein a first recess of the plurality of recesses is shaped to substantially receive a portion of a hemisphere-shaped distal end of a first protrusion of the plurality of protrusions, the outsole bottom surface is comprised of a plurality of outsole protrusions, wherein the plurality of outsole protrusions correspond to the plurality of recesses; and a bonding agent, wherein the bonding agent couples the midsole to the outsole proximate a portion of the perimeter and proximate a portion the hemisphere-shaped distal end of the first protrusion, the midsole and the outsole are not coupled proximate the baseline bottom surface that is remote from the perimeter.

2. The footwear sole of claim 1, wherein the midsole is formed from a foam material.

3. The footwear sole of claim 1, wherein the midsole and the plurality of protrusions are formed from a common material.

4. The footwear sole of claim 1, wherein a first protrusion of the plurality of protrusions has a greater downward extension measured from the midsole top surface than a second protrusion of the plurality of protrusions.

5. The footwear sole of claim 4, wherein the first protrusion is positioned closer to the midsole heel end than the second protrusion.

6. The footwear sole of claim 1 further comprising an outsole supplement, wherein the outsole supplement is coupled to a portion of the bottom surface of the outsole.

7. The footwear sole of claim 1 further comprising an insert coupled to the midsole proximate the midsole top surface.

8. The footwear sole of claim 1, wherein the concave contour of each recess of the plurality of recesses correspond to an associated protrusion of the outsole bottom surface.

9. The footwear sole of claim 1, wherein the midsole and the outsole are coupled along a perimeter defined by the midsole toe end, the midsole lateral side, the midsole heel end, and the midsole medial side.

10. The footwear sole of claim 9, wherein a substantially air-tight bond is formed along the perimeter to maintain a volume of air between the midsole and the outsole during a compression of the footwear sole by a user.

11. A footwear sole, comprising:

a midsole having a midsole perimeter, a midsole top surface, and a baseline bottom surface, wherein a plurality of protrusions extend downwardly from the baseline bottom surface such that the plurality of protrusions form a protrusion bottom surface of the midsole, the plurality of protrusions and the midsole are formed of a cohesive material;

and an outsole having an outsole top surface and an outsole bottom surface, the outsole bottom surface being comprised of a plurality of outsole protrusions, wherein the plurality of outsole protrusions corresponds to the plurality of protrusions of the midsole, wherein the outsole and the midsole are affixed proximate a portion of the midsole perimeter and proximate a portion of the protrusion bottom surface, and the outsole and the midsole are not affixed proximate the baseline bottom surface remote from the midsole perimeter.

12. The footwear sole of claim 11, wherein each of the plurality of protrusions are substantially circular in a horizontal cross-section of each of the plurality of protrusions.

13. The footwear sole of claim 11, wherein a portion of the baseline bottom surface surrounds each of the plurality of protrusions proximate the baseline bottom surface.

14. The footwear sole of claim 11, wherein the plurality of protrusion are discontinuously dispersed across substantially all of the midsole proximate the baseline bottom surface.

15. The footwear sole of claim 11, wherein the protrusion bottom surface and the baseline bottom surface form a midsole bottom surface.

16. The footwear sole of claim 11, wherein the cohesive material is a foam material having location varied densities, such that a first region of the midsole has a first density and a second region of the midsole has a second density.

17. The footwear sole of claim 11, wherein the outsole top surface is comprised of a plurality of recesses formed to receive a distal end portion of each protrusion of the plurality of protrusions.

18. The footwear sole of claim 11, wherein a portion of the outsole is semi-transparent such that a first protrusion of the plurality of protrusion is able to be viewed through the outsole.

* * * * *